US009175657B2

(12) United States Patent
Kaneda et al.

(10) Patent No.: US 9,175,657 B2
(45) Date of Patent: Nov. 3, 2015

(54) ENGINE STARTING DEVICE

(75) Inventors: Naohito Kaneda, Chiyoda-ku (JP); Daisuke Mizuno, Chiyoda-ku (JP); Koichiro Kamei, Chiyoda-ku (JP); Kazuhiro Odahara, Chiyoda-ku (JP); Masami Abe, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/977,869

(22) PCT Filed: Mar. 31, 2011

(86) PCT No.: PCT/JP2011/058211

§ 371 (c)(1),
(2), (4) Date: Jul. 1, 2013

(87) PCT Pub. No.: WO2012/131975

PCT Pub. Date: Oct. 4, 2012

(65) Prior Publication Data

US 2013/0291681 A1 Nov. 7, 2013

(51) Int. Cl.
*F02N 11/00* (2006.01)
*F02N 15/06* (2006.01)
(Continued)

(52) U.S. Cl.
CPC ..... *F02N 11/00* (2013.01); *F02N 15/062* (2013.01); *F02N 11/0851* (2013.01);
(Continued)

(58) Field of Classification Search
CPC ..... F02N 15/06; F02N 15/065; F02N 15/023; F02N 15/067; F02N 15/066; F02N 15/062; F02N 11/00; F02N 19/001; F02N 15/022; F02N 11/0851; F02N 11/0855; F02N 15/04; F02N 2015/061; F02N 15/063; Y10T 74/132; Y10T 74/133; Y10T 74/134; Y10T 74/137; Y10T 74/136; Y10T 74/138; Y10T 74/139
USPC .... 74/7 R, 7 A, 7 B, 7 C, 7 D, 7 E; 310/75 R, 310/90, 91, 99, 100
See application file for complete search history.

(56) References Cited

U.S. PATENT DOCUMENTS 1,348,288 A 8/1920 McGrath
2,423,068 A * 6/1947 Edwin et al. ..... 74/7 B
(Continued)

FOREIGN PATENT DOCUMENTS

EP 2151573 A2 2/2010
EP 2650529 A1 10/2013
(Continued)

OTHER PUBLICATIONS

European Search Report; issued Aug. 5, 2014; Patent Application No. 11862741.3.
(Continued)

*Primary Examiner* — William Kelleher
*Assistant Examiner* — Jude Agendia
(74) *Attorney, Agent, or Firm* — Sughrue Mion, PLLC

(57) ABSTRACT

A pinion gear unit includes a rotation member rotating according to the rotation of a output shaft. A first pinion gear fit to the rotation member through a first serration unit rotates with, and also moves with the rotation member if the pinion gear unit moves towards an engagement location with an engine starting gear. A second pinion gear is fit to the rotation member adjacent to the first pinion gear through a second serration unit, rotates with and moves with the rotation member if the pinion gear unit further moves towards the engagement location, and engages with the starting gear later than the first pinion gear, where the first pinion gear engages with the engine starting gear. Fitting is performed by the first and second serration units so that phases of teeth of the first and second pinion gears in a circumferential direction correspond with each other.

15 Claims, 5 Drawing Sheets

(51) Int. Cl.

| | |
|---|---|
| *F02N 15/02* | (2006.01) |
| *F02N 15/04* | (2006.01) |
| *F02N 11/08* | (2006.01) |

(52) U.S. Cl.

CPC ..... *F02N 15/023* (2013.01); *F02N 15/046* (2013.01); *F02N 15/063* (2013.01); *F02N 15/065* (2013.01); *F02N 15/067* (2013.01); *Y10T 74/132* (2015.01)

(56) References Cited

U.S. PATENT DOCUMENTS

| | | | | |
|---|---|---|---|---|
| 4,488,054 | A * | 12/1984 | Ebihara | 290/38 A |
| 5,046,373 | A | 9/1991 | Zabrowski et al. | |
| 5,735,169 | A * | 4/1998 | Niimi et al. | 74/7 A |
| 5,767,585 | A * | 6/1998 | Shiga et al. | 290/38 R |
| 5,945,742 | A * | 8/1999 | Araki et al. | 290/38 R |
| 6,851,405 | B2 * | 2/2005 | Kajino et al. | 123/179.25 |
| 6,880,415 | B2 * | 4/2005 | Nito | 74/6 |
| 7,302,869 | B2 * | 12/2007 | Kamei et al. | 74/6 |
| 7,859,150 | B2 * | 12/2010 | Utsunomiya et al. | 310/75 R |
| 8,307,726 | B2 * | 11/2012 | Niimi | 74/7 A |
| 8,402,849 | B2 * | 3/2013 | Niimi et al. | 74/7 C |
| 8,408,175 | B2 * | 4/2013 | Schoenek et al. | 123/179.1 |
| 2004/0079179 | A1 * | 4/2004 | Holzleitner | 74/7 B |
| 2007/0137325 | A1 * | 6/2007 | Murase et al. | 74/7 E |
| 2008/0257077 | A1 * | 10/2008 | Ono et al. | 74/6 |
| 2010/0033066 | A1 | 2/2010 | Murata et al. | |
| 2012/0119497 | A1 | 5/2012 | Murata et al. | |
| 2013/0233128 | A1 * | 9/2013 | Mizuno et al. | 74/7 E |
| 2013/0276579 | A1 | 10/2013 | Abe et al. | |
| 2013/0291680 | A1 | 11/2013 | Odahara et al. | |

FOREIGN PATENT DOCUMENTS

| | | | |
|---|---|---|---|
| EP | 2693042 | A1 | 2/2014 |
| EP | 2693043 | A1 | 2/2014 |
| JP | 3-78567 | A | 4/1991 |
| JP | 4-43863 | A | 2/1992 |
| JP | 07-010606 | U | 2/1995 |
| JP | 9-42123 | A | 6/1998 |
| JP | 2002-70699 | A | 3/2002 |
| JP | 2002-303236 | A | 10/2002 |
| JP | 2006-132343 | A | 5/2006 |
| JP | 2009-168230 | A | 7/2009 |
| JP | 2009-191843 | A | 8/2009 |
| WO | 2010069645 | A1 | 6/2010 |

OTHER PUBLICATIONS

Communication dated May 22, 2015, issued by the State Intellectual Property Office of the People's Republic of China in corresponding Chinese Application No. 201180069768.9.

* cited by examiner c VIEW ENLARGED VIEW d VIEW ENLARGED VIEW c VIEW ENLARGED VIEW d VIEW ENLARGED VIEW

ENGINE STARTING DEVICE

CROSS REFERENCE TO RELATED APPLICATIONS

This application is a National Stage of International Application No. PCT/JP2011/058211, filed on Mar. 31, 2011, the contents of all of which are incorporated herein by reference in their entirety.

TECHNICAL FIELD

The present invention relates to an engine starting device including a motor unit, a pinion gear unit which rotates according to the rotation of an output rotation shaft driven by the motor unit, and a pushing mechanism which moves the pinion gear unit towards an engagement location of a pinion gear and an engine starting gear, in which an engine is started by a rotation force of the motor unit through the pinion gear and the engine starting gear which are engaged with each other, and particularly relates to the improvement of engagement of a pinion gear and an engine starting gear such as a ring gear on an engine side (hereinafter, referred to as a "ring gear") in an engine starting device at the time of engine starting.

BACKGROUND ART

In an engine starting device (hereinafter, referred to as a starter) of the related art, a starting operation is performed in a state where an engine is stopped. Accordingly, a pinion gear has been engaged with a ring gear, in a state where the ring gear is not rotating. However, in a system for performing idling stop for low fuel consumption, restarting performance is secured by engaging a pinion gear and a ring gear even in ring gear rotation.

For example, when restarting is required in a state where engine rotation is not stopped at the time of idling stop, or when shortening of time is required when restarting from the stopped state, engagement with a pinion gear is previously performed in rotation of a ring gear.

In this case, as a method of engaging a pinion gear in rotation of a ring gear, there has been known a method of engaging the gears by turning on and controlling the speed of a starter motor of the pinion gear so as to be synchronized with a rotation speed of the ring gear (for example, see Patent Literature 1). In addition, there has been known a method of engaging the gears by providing a mechanism for previous synchronization and performing synchronization to have constant difference of the rotation speed by friction of the mechanism unit (for example, see Patent Literature 2). Further, there has been known a method of devising a pinion formation to easily perform the engagement (for example, see Patent Literature 3).

Citation List

[Patent Literature 1] JP-A-2002-70699 (Abstract, FIG. 3 and the description thereof)

[Patent Literature 2] JP-A-2006-132343 (Abstract, FIG. 2 and the description thereof)

[Patent Literature 3] JP-A-2009-168230 (Abstract, FIG. 1 and the description thereof)

SUMMARY OF INVENTION

Technical Problem

However, the technologies of the related art have the following problems.

The speed of the ring gear is decreased by inertia rotation after stopping the engine, however, in this case, the gear is stopped while pulsating the rotation speed by the fluctuation of torque due to compression and expansion of a piston. Accordingly, for example, as disclosed in Patent Literature 1, a complicated configuration is necessary for synchronizing the rotation speed of the ring gear and the pinion gear to engage them in the engine starting device (starter). In detail, a complicated configuration of acquiring or expecting the rotation speed of the ring gear and the pinion gear and controlling the starter and engaging the gears based on the rotation speed, is necessary.

In addition, not only the synchronization, but the phases of the pinion gear and the ring gear are also necessary to be corresponded with each other for the engagement. Thus, it is necessary to recognize accurate locations of the rotating direction with respect to respective synchronized gears. However, in order to perform such high-precision control, a detector such as a high-precision encoder, or a high-speed operation process of an ECU on an engine side is necessary. In addition, since the pinion gear itself is a moving object, it is difficult to detect the phase of the pinion gear by an encoder or the like, the system becomes complicated, and the apparatus becomes larger in size.

Further, even in a case in which the complicated configuration is realized by simplifying the configuration by a method of expecting each rotation and engaging the pinion, since difference in the rotation speed at the time of abutting is generated due to an error of expected values and variation in timing for engaging the pinion in an axial direction, precise control is difficult.

On the other hand, for example, as disclosed in Patent Literature 2, by using a configuration of previously matching the rotation speed of the pinion gear and the ring gear by a synchronization mechanism to abut the gears, it is possible to synchronize the rotation speed of the ring gear and the pinion gear with a simpler configuration. However, in general, the pinion gear and the ring gear are provided with a gear ratio level of 10 times for miniaturization of the motor, and do not exist on the same axis because of restriction of a dimensional configuration. Accordingly, the synchronization is performed while slipping occurs on a friction surface of the synchronization mechanism for abutting the pinion gear to the ring gear, at all times, and thus, it is difficult to realize the synchronization in which the phases thereof are completely matched.

In addition, in the synchronization mechanism, at the time of abutting the ring gear and the pinion gear after synchronizing the rotation of the ring gear and the pinion gear, except for a case where the phases thereof are accidently matched with each other at that time, slipping occurs between the ring gear and the pinion gear, and they are engaged at the time when the phases thereof are matched with each other. As described above, in the configuration of using the synchronization mechanism, after synchronizing due to the slipping, the pinion gear and the ring gear are abutted to each other. Accordingly, there is a problem of noise or abrasion at that time or a problem that a separate space is necessary, because the abrasion surfaces to be separately synchronized are necessary.

In addition, for example, in the case of using the synchronization mechanism, as disclosed in Patent Literature 3, there is a concern that a formation of an edge of the pinion is devised and an edge of a gear tooth is chamfered to realize easier engagement of the pinion gear and the ring gear. Therefore, in Patent Literature 3, insertion in the space provided by the chamfering can be performed and an attracting effect by surface abutting is exhibited.

Here, the attracting effect by chamfering is exhibited as long as the engagement is performed in a state where the ring gear is stopped. However, in a case where the relative rotation speed of the pinion is different in the rotation of the ring gear, since both gears collide with each other due to abutting of the chamfered portion, a force component which pushes the pinion back to the axial direction is generated. Accordingly, there is a problem of generation of collision noise at the time of the engagement or delay of the engagement.

As described above, in a case of engaging the pinion gear in the rotation of the ring gear, if reliable rotation synchronization and phase focusing of the pinion gear and the ring gear are not performed at the time when the pinion gear is abutted to the ring gear, shortening of the life due to noise and abrasion, and delay of starting due to loss of the engagement time may occur.

In particular, at the time of the engagement of the pinion gear and the ring gear, when the difference in the rotation speed between the pinion gear and the ring gear is large, the engagement is performed while generating noise due to the scraping of the pinion gear tooth and the ring gear tooth. As a result, with the problem of the shortened life due to the abrasion of the teeth, a torque force of the difference in rotation speeds in the chamfered surface becomes a force in the axial direction, the pinion gear is largely popped out, and the loss in engagement time is generated to degrade restarting performance.

The present invention has been made to address the aforementioned problems and aims at obtaining an engine starting device which performs more reliable rotation synchronization and phase focusing of a pinion gear and a ring gear (engagement positioning of the pinion gear tooth and the ring gear tooth) at the time when the pinion gear is abutted to the ring gear, even in a case of engagement of the pinion gear and the ring gear in rotation of the ring gear, and suppresses the shortening of life due to noise and abrasion, and delay of starting performance due to loss of engagement time.

Solution to Problem

An engine starting device according to the present invention includes: a motor unit; a pinion gear unit which rotates according to the rotation of an output rotation shaft driven by the motor unit; and a pushing mechanism which moves the pinion gear unit towards an engagement location of a pinion gear and an engine starting gear, an engine is started by a rotation force of the motor unit through the pinion gear and the engine starting gear which are engaged with each other, the pinion gear unit includes a rotation member which rotates according to the rotation of the output rotation shaft, a first pinion gear which is fit to the rotation member through a first serration unit, rotates with the rotation member according to the rotation of the output rotation shaft, and moves with the rotation member if the pinion gear unit moves towards the engagement location by the pushing mechanism, to be initially engaged with the engine starting gear, and a second pinion gear which is fit to the rotation member to be adjacent to the first pinion gear through a second serration unit, rotates with the rotation member according to the rotation of the output rotation shaft, and moves with the rotation member if the pinion gear unit further moves towards the engagement location by the pushing mechanism, to be engaged with the engine starting gear later than the first pinion gear, in a state where the first pinion gear is engaged with the engine starting gear, and the fitting is performed by the first and second serration units so that phases of teeth of the first pinion gear and teeth of the second pinion gear in a circumferential direction correspond with each other.

In addition, a positioning mechanism unit is provided over the first serration unit and the second serration unit, and the fitting is performed by the positioning structure unit provided over the first and second serration units so that the phases of the teeth of the first pinion gear and the teeth of the second pinion gear in a circumferential direction correspond with each other.

Further, the number of teeth of the first serration unit is integral multiple of the number of teeth of the first pinion gear, and the number of teeth of the second serration unit is integral multiple of the number of teeth of the second pinion gear.

Advantageous Effects of Invention

According to the present invention, since the pinion gear unit includes the rotation member which rotates according to the rotation of the output rotation shaft, the first pinion gear which is fit to the rotation member through the first serration unit, rotates with the rotation member according to the rotation of the output rotation shaft, and moves with the rotation member if the pinion gear unit moves towards the engagement location by the pushing mechanism, to be initially engaged with the engine starting gear, and the second pinion gear which is fit to the rotation member to be adjacent to the first pinion gear through the second serration unit, rotates with the rotation member according to the rotation of the output rotation shaft, and moves with the rotation member if the pinion gear unit further moves towards the engagement location by the pushing mechanism, to be engaged with the engine starting gear later than the first pinion gear, in a state where the first pinion gear is engaged with the engine starting gear, and the fitting is performed by the first and second serration units so that phases of teeth of the first pinion gear and teeth of the second pinion gear in a circumferential direction correspond with each other, it is possible to obtain an engine starting device in which the pinion gear and the engine starting gear can be stably engaged with each other, even in a case of difference in a rotation speed between the pinion gear unit and the engine starting gear, more reliable rotation synchronization and the phase focusing are performed at the time when the first pinion gear and the engine starting gear are abutted to each other, even in a case of engaging the pinion gear in rotation of the engine starting gear, and shortening of the life due to noise and abrasion, and delay of starting performance due to loss of the engagement time do not occur, with low cost by a simple assembly operation.

DESCRIPTION OF EMBODIMENTS

Embodiment 1

Figure 1:
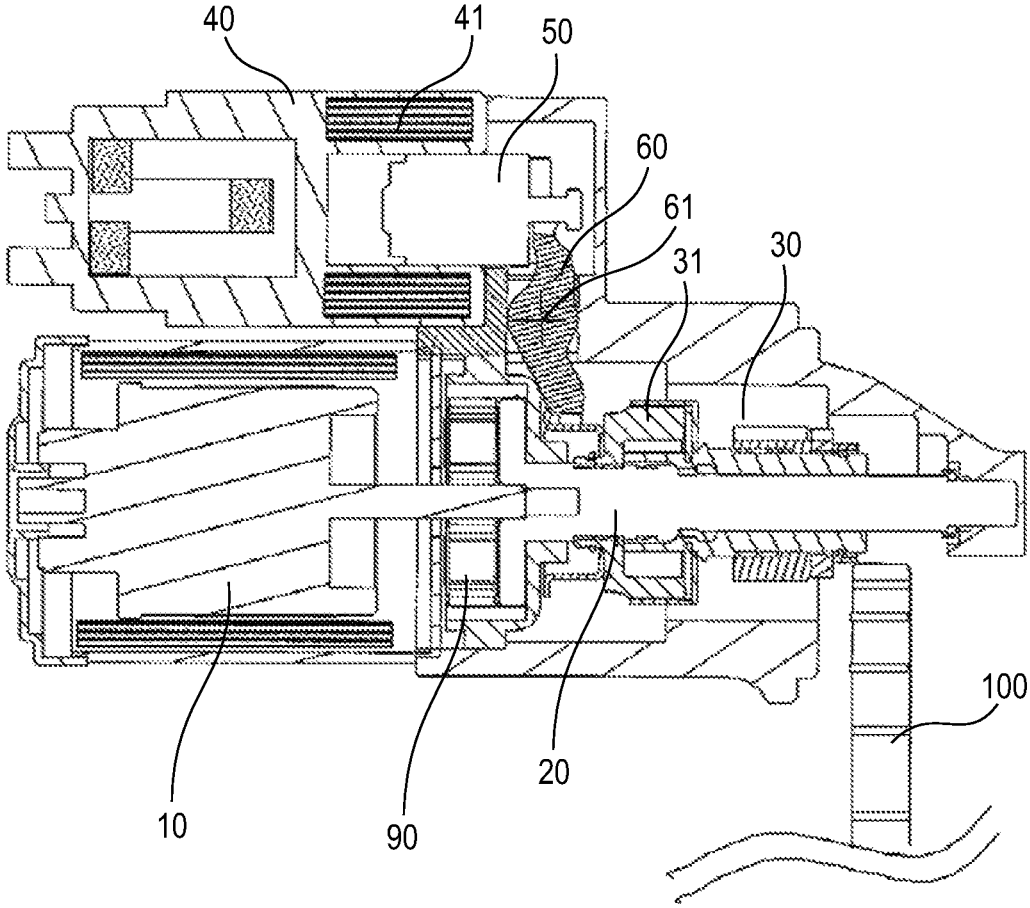
FIG. 1 is a view showing Embodiment 1 of the invention and is a front longitudinal sectional view showing an example of an engine starting device.
Figure 2A:
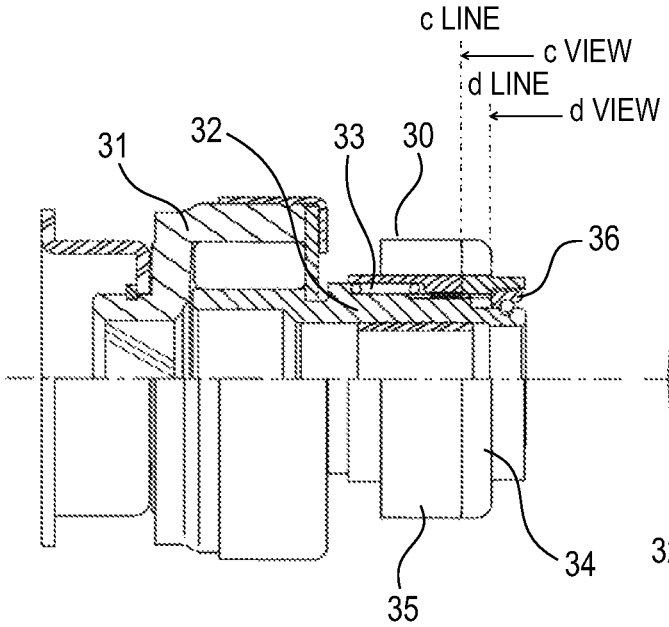
FIG. 2 is a view showing Embodiment 1 of the invention and is a view showing a pinion gear unit of FIG. 1, wherein FIG. 2(*a*) is a front view, FIG. 2(*b*) is a right side view, FIG. 2(*c*) is an enlarged view of c view when seen in a direction of a left-pointing arrow in the drawing from a c line portion of FIG. 2(*a*), and FIG. 2(*d*) is an enlarged view of d view when seen in a direction of a left-pointing arrow in the drawing from a d line portion of FIG. 2(*a*).
Figure 2B:
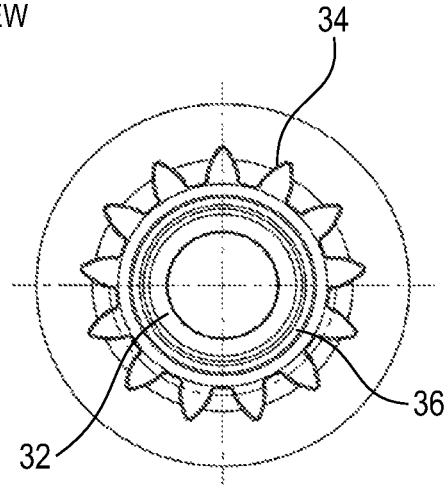
Figure 2C:
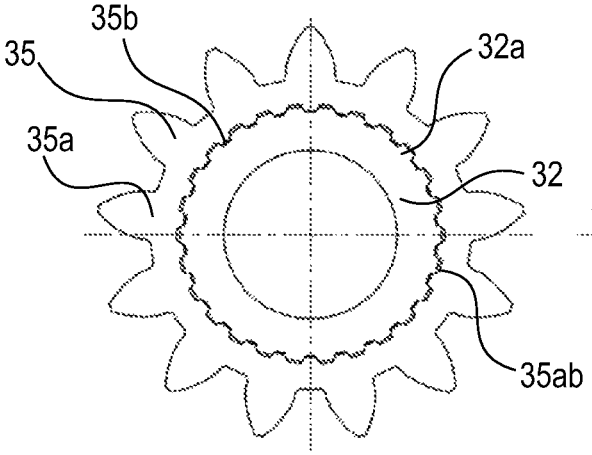
Figure 2D:
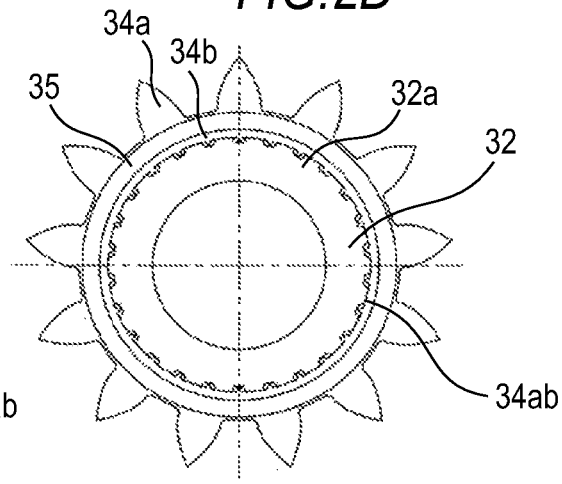
Figure 3A:
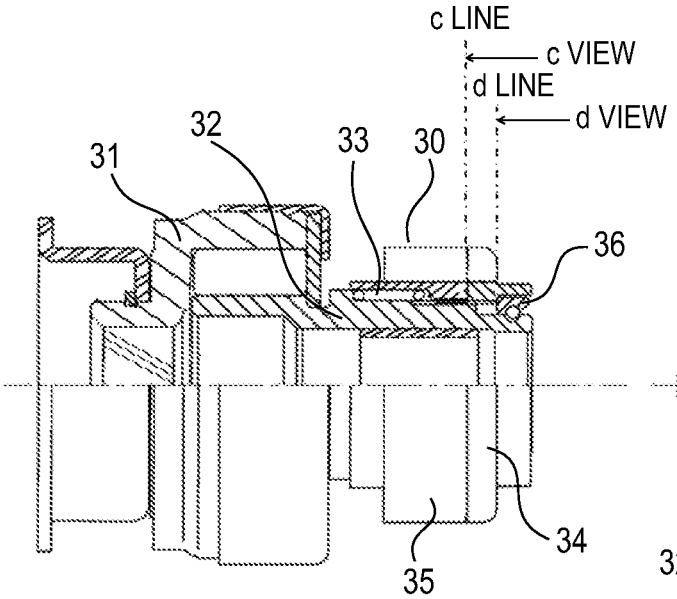
FIG. 3 is a view showing Embodiment 2 of the invention and is a view showing another example of a pinion gear unit, wherein FIG. 3(*a*) is a front view, FIG. 3(*b*) is a right side view, FIG. 3(*c*) is an enlarged view of c view when seen in a direction of a left-pointing arrow in the drawing from a c line portion of FIG. 3(*a*), and FIG. 3(*d*) is an enlarged view of d view when seen in a direction of a left-pointing arrow in the drawing from a d line portion of FIG. 3(*a*).
Figure 3B:
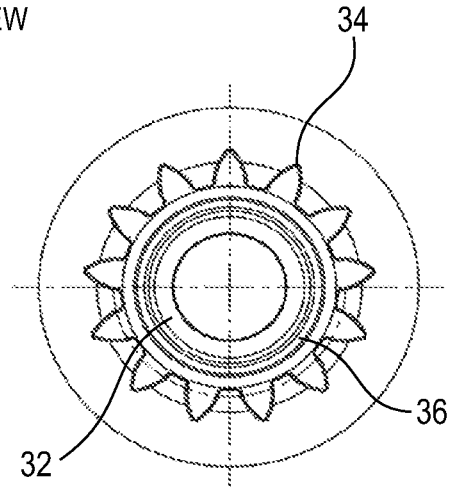
Figure 3C:
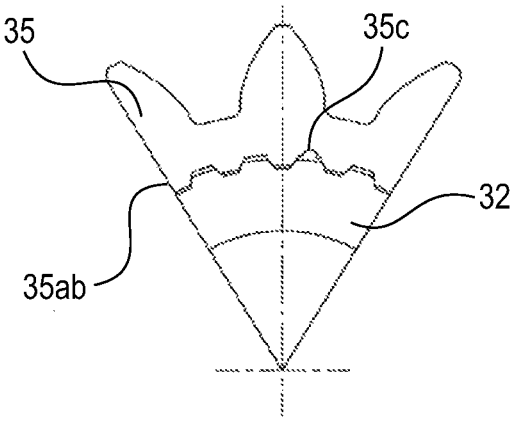
Figure 3D:
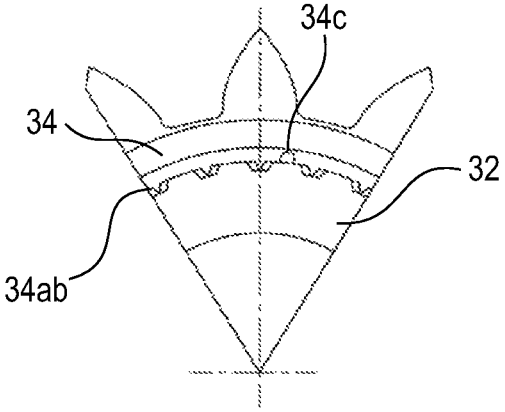
Figure 4A:
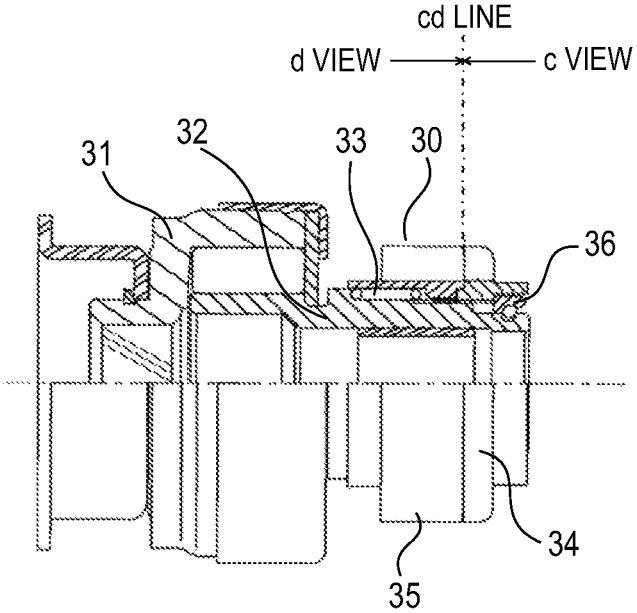
FIG. 4 is a view showing Embodiment 5 of the invention and is a view showing still another example of a pinion gear unit, wherein FIG. 4(*a*) is a front view, FIG. 4(*b*) is a right side view, FIG. 4(*c*) is an enlarged view of c view when seen in a direction of a left-pointing arrow in the drawing from a cd line portion of FIG. 4(*a*), and FIG. 4(*d*) is an enlarged view of d view when seen in a direction of a right-pointing arrow in the drawing from a cd line portion of FIG. 4(*a*).
Figure 4B:
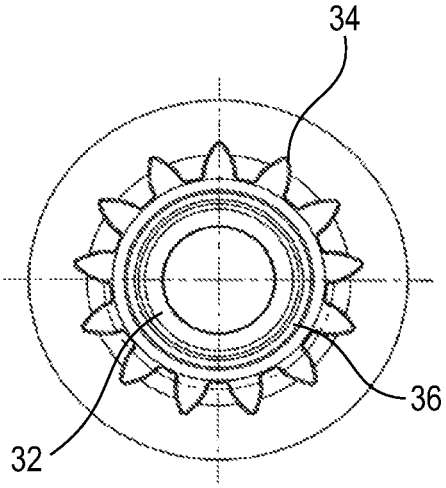
Figure 4C:
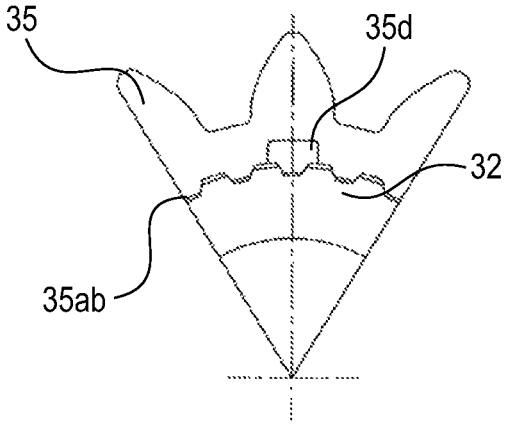
Figure 4D:
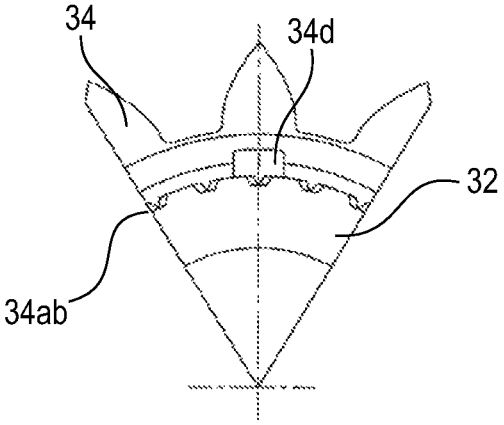

Hereinafter, Embodiment 1 of the invention will be described with reference to FIG. 1 and FIG. 2. FIG. 1 is a front longitudinal sectional view showing an example of an engine starting device. FIG. 2 is a view showing a pinion gear unit of FIG. 1, wherein FIG. 2(*a*) is a front view, FIG. 2(*b*) is a right side view, FIG. 2(*c*) is an enlarged view of c view when seen in a direction of a left-pointing arrow in the drawing from a c line portion of FIG. 2(*a*), and FIG. 2(*d*) is an enlarged view of d view when seen in a direction of a left-pointing arrow in the drawing from a d line portion of FIG. 2(*a*).

An engine starting device of Embodiment 1 shown in FIG. 1 is configured with a motor unit (hereinafter referred to as a "motor driving force unit") 10 which generates a driving force for starting an engine, an output rotation shaft 20, a pinion gear unit 30, an attraction coil unit 40, a plunger 50, a pushing mechanism such as a lever (hereinafter, referred to as a "lever") 60, a bracket 70, a stopper 80, and a reduction gear unit 90.

The motor driving force unit 10 generates a rotation force for starting an engine. The output rotation shaft 20 is coupled to an output shaft side of the motor through the reduction gear unit 90, and is rotatably driven by the driving force unit 10. The pinion gear unit 30 is integrated with a overrunning clutch (one-direction clutch) which is coupled to the output rotation shaft 20 by a helical spline, and can slide in an axial direction of the output rotation shaft 20 (a direction of an engine starting gear such as a ring gear (hereinafter, referred to as a "ring gear")).

The attraction coil unit 40 generates an electromagnetic force by turning on a switch (not shown), and attracts the plunger 50 by the electromagnetic force. The lever 60 rotates around the pivot shaft by movement of the plunger 50 due to the attraction, and the pinion gear unit moves towards an engagement location of the pinion gear and the engine starting gear by the rotation. The bracket 70 fixes components of the engine starting device such as the motor driving force unit 10, the output rotation shaft 20, and the pinion gear unit 30, on the engine side.

The pinion gear 30 of Embodiment 1 shown in FIG. 2 is configured with a moving body 31 mounted in the overrunning clutch, a tubular rotation member 32, an elastic member 33 such as a coil spring, a first pinion gear 34, a second pinion gear 35, a stopper unit 36, and the like.

In addition, a serration unit 32*a* is provided on an outer periphery of the cylindrical rotation member 32.

Pinion teeth 34*a* for rotation synchronization which can be engaged with a ring gear 100 are provided on the outer periphery of the first pinion gear 34, and a serration unit 34*b* which can be fit to serration units 32*a* of the rotation member 32 is provided on the inner periphery thereof. In addition, as shown in FIGS. 2(*a*) and 2(*d*), the pinion teeth 34*a* of the first pinion gear 34 are in a protruded teeth shape in which an edge is in a protruded shape, and in a shape to perform rotation synchronization to be easily engaged with the ring gear 100, and is thin in the axial direction.

Pinion teeth 35*a* for rotation synchronization and for rotation force transfer and a serration unit 34*b* which can be fit to the serration units 32*a* of the rotation member 32 at the time of engagement with the ring gear 100 are provided on the second pinion gear 35. In addition, as shown in FIGS. 2(*a*) and 2(*c*), the pinion teeth 35*a* of the second pinion gear 35 are in a non-protruded teeth shape in which an edge is cut out, and in a shape to perform rotation synchronization with the ring gear 100 and have a strength to transfer the rotation force to the ring gear 100 when the second pinion gear 35 is moved to the direction of the ring gear 100 after the ring gear 100 is engaged with the first pinion gear 34, and is thick in the axial direction.

The number of the pinion teeth 35*a* of the second pinion gear 35 is the same as the number of the pinion teeth 34*a* of the first pinion gear 34.

The serration unit 32*a* of the rotation member 32 and the serration 34*b* of the first pinion gear 34 are serration-fit to each other to be relatively movable in the axial direction and configure a first serration unit 34*ab*, and the serration unit 32*a* of the rotation member 32 and serration 35*b* of the second pinion gear 35 are serration-fit to each other to be relatively movable in the axis direction and configure a second serration unit 35*ab*.

The number of teeth of the first serration unit 34*ab* is integral multiple of the number of the pinion teeth 34*a* of the first pinion gear 34, and the number of teeth of the second serration unit 35*ab* is integral multiple of the number of the pinion teeth 35*a* of the second pinion gear 35.

As a result, at the time of assembly, the positioning of the outer circumferential directions of the pinion teeth 34*a* of the first pinion gear 34 and the pinion teeth 35*a* of the second pinion gear 35, that is, the phase focusing can be easily performed.

Embodiment 2

Hereinafter, Embodiment 2 of the invention will be described with reference to FIG. 3. FIG. 3 is a view showing another example of a pinion gear unit, wherein FIG. 3(*a*) is a front view, FIG. 3(*b*) is a right side view, FIG. 3(*c*) is an enlarged view of c view when seen in a direction of a left-pointing arrow in the drawing from a c line portion of FIG. 3(*a*), and FIG. 3(*d*) is an enlarged view of d view when seen in a direction of a left-pointing arrow in the drawing from a d line portion of FIG. 3(*a*).

In the pinion gear unit 30 of Embodiment 2 shown in FIG. 3, groove unit 34*c* is provided on the inner periphery side of the first pinion gear 34 and groove unit 35*c* is provided on the inner periphery of the second pinion gear 35, respectively.

As a result, at the time of assembly of the first and second pinion gears 34 and 35 to the rotation member 32, by overlapping the groove units 34*c* and 35*c* with each other, the positioning of the outer circumferential directions of the pinion teeth 34*a* of the first pinion gear 34 and the pinion teeth 35*a* of the second pinion gear 35, that is, the phase focusing can be easily performed. In addition, the operation of corresponding the groove units 34*c* and 35*c* with each other may be performed visually or may be performed using a tool (not shown).

Embodiment 3

In addition, the groove units 34*c* and 35*c* have been used in Embodiment 2, however, each one tooth of the serration units 34*b* and 35*b* is cut out and the cut-out portions may be used instead of the groove units 34*c* and 35*c*.

Embodiment 4

Further, the width of each one tooth of the serration units 34*b* and 35*b* is changed with the width of the other teeth, and each one tooth, the width of which is different from other teeth may be used for positioning. At that time, in a case of the wide width, it is also necessary to change the serration of the serration unit 32*a* corresponding to the widened one tooth.

Embodiment 5

Hereinafter, Embodiment 5 of the invention will be described with reference to FIG. 4. FIG. 4 is a view showing still another example of a pinion gear unit, wherein FIG. 4(*a*) is a front view, FIG. 4(*b*) is a right side view, FIG. 4(*c*) is an enlarged view of c view when seen in a direction of a left-pointing arrow in the drawing from a cd line portion of FIG. 4(*a*), and FIG. 4(*d*) is an enlarged view of d view when seen in a direction of a left-pointing arrow in the drawing from a cd line portion of FIG. 4(*a*).

The pinion gear unit 30 of Embodiment 5 shown in FIG. 4 includes a protruded portion 34*d* on a part of a surface of the first pinion gear 34 which comes in contact with the second pinion gear 35, and a recessed portion 35*d* facing the protruded portion 34*d* on a surface of the second pinion gear 35 which comes in contact with the first pinion gear 34.

As a result, at the time of assembly of the first and second pinion gears 34 and 35 to the rotation member 32, the protruded portion 34*d* and the recessed portion 35*d* may be fit to each other, and the positioning of the outer circumferential directions of the pinion teeth 34*a* of the first pinion gear 34 and the pinion teeth 35*a* of the second pinion gear 35, that is, the phase focusing can be easily performed. In addition, the protruded portion 34*d* and the recessed portion 35*d* are provided on the first pinion gear 34 and the second pinion gear 35, respectively, however, the recessed portion may be provided on the first pinion gear 34 and the protruded portion may be provided on the second pinion gear 35, in an opposite manner.

Embodiment 6

Figure 5:
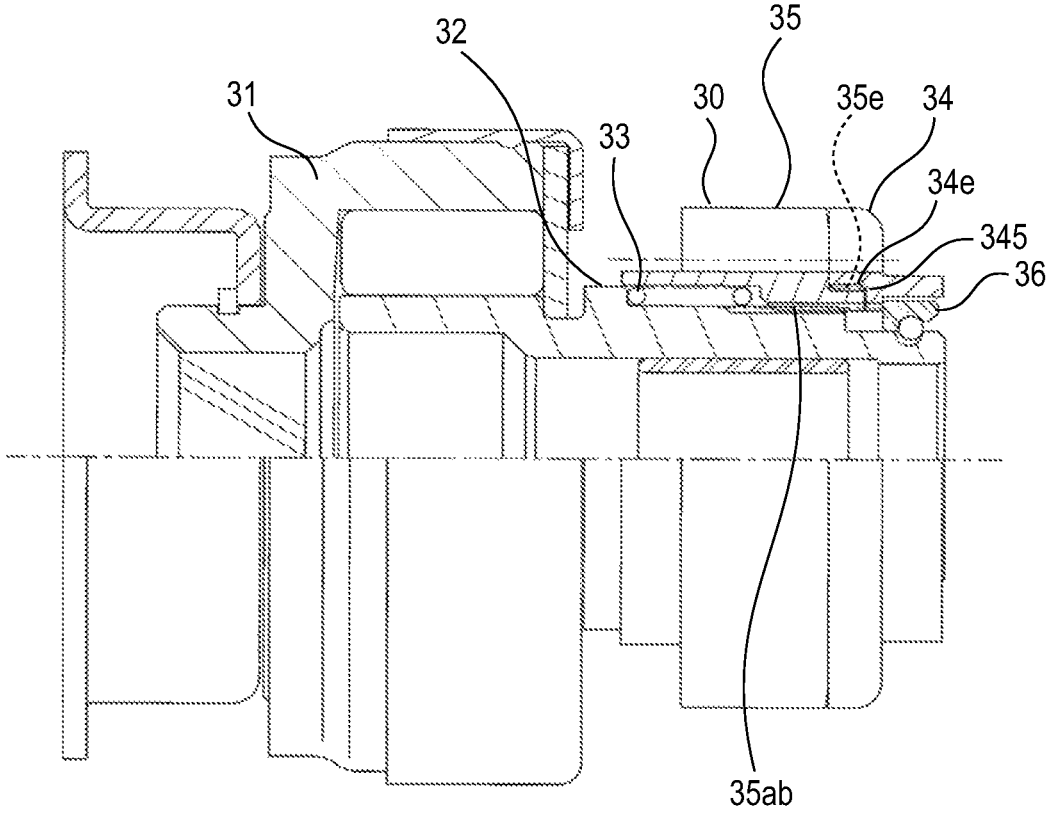
FIG. 5 is a view showing Embodiment 6 of the invention and is a front view showing still another example of a pinion gear unit.

Hereinafter, Embodiment 6 of the invention will be described with reference to FIG. 5. FIG. 5 is a front view showing still another example of a pinion gear unit.

The pinion gear unit 30 of Embodiment 6 shown in FIG. 5 has a structure in which an inner periphery surface portion of a large diameter of the first pinion gear 34 on a side opposite to the ring gear 100 is freely fit to an outer periphery surface portion of a small diameter of the second pinion gear 35 on the ring gear 100 side by serration-coupling as shown in the drawing, and the first pinion gear 34 can be moved in a circumferential direction and a radial direction for a predetermined amount with respect to the second pinion gear 35, and can also be moved in the axial direction.

A first pinion gear side serration unit 34*e* is formed on the inner periphery surface portion of the first pinion gear 34 facing the outer periphery surface portion of the second pinion gear 35, and a second pinion gear side serration unit 35*e* is formed on the outer periphery surface portion of the second pinion gear 35 facing the inner periphery surface portion of the first pinion gear 34. An inter-pinion gear serration unit 345*e* is configured with the first pinion gear side serration unit 34*e* and the second pinion gear side serration unit 35*e*.

The first pinion gear side serration unit 34*e* and the second pinion gear side serration unit 35*e* are fit to each other to have a backlash, that is, freely fit to each other, and accordingly, the first pinion gear 34 can be moved in the circumferential direction and the radial direction for a predetermined amount with respect to the second pinion gear 35, and can also be moved in the axial direction.

The backlash in the circumferential direction is formed by forming a gap with a predetermined interval between the edge surface of the tooth unit of the first pinion gear side serration unit 34*e* in the circumferential direction and the edge surface of the tooth unit of the second pinion gear side serration unit 35*e* in the circumferential direction.

The backlash in the radial direction is formed by forming a gap with a predetermined interval between the tip surface of the tooth unit of the first pinion gear side serration unit 34*e* in the radial direction and the bottom surface of the valley portion between the teeth of the second pinion gear side serration unit 35*e* in the radial direction, and forming a gap with a predetermined interval between the tip surface of the tooth unit of the second pinion gear side serration unit 35*e* in the radial direction and the bottom surface of the valley portion between the teeth of the first pinion gear side serration unit 34*e* in the radial direction.

As a result, in the prior stage of the time of assembly of the first and second pinion gears 34 and 35 to the rotation member 32, the first serration units 34*e* and 35*e* may be fit to each other, and the positioning of the outer circumferential directions of the pinion teeth 34*a* of the first pinion gear 34 and the pinion teeth 35*a* of the second pinion gear 35, that is, the phase focusing can be easily performed.

In addition, by the backlash in the radial direction due to the freely-fitting, the first pinion gear 34 can be inclined with respect to the second pinion gear 35. Accordingly, when the first pinion gear 34 is collided with the ring gear 100 by the movement of the first pinion gear itself in the direction of the ring gear 100 at the time of engine starting, the first pinion gear can be inclined, and due to the inclination, the first pinion gear can be easily engaged with the ring gear 100 and early engagement with the ring gear 100 is possible. Further, the second pinion gear 35 can also be easily engaged with the ring gear 100 and early engagement with the ring gear 100 is possible.

Since the first pinion gear 34 and the second pinion gear 35 are separated different bodies, strength with respect to transfer torque (transfer of rotation torque from the engine starting device to the engine side, and vice versa) is given to the second pinion gear 35, and the first pinion gear 34 can have a shape, a thickness in the axial direction, and mass only for the engagement by almost ignoring strength securing with respect to the transfer torque at the time of engagement, such that the degree of freedom for the shape and material becomes high and the processing is easily performed.

In addition, the same reference numerals in each drawing of FIGS. 1 to 5 denote the same or corresponding portions.

In addition, as clear in the above description and each drawing described above, the following technical features are provided in FIGS. 1 to 5 and Embodiments 1 to 6 of the invention.

Feature 1: In an engine starting device including a motor unit 10, a pinion gear unit 30 which rotates according to rotation of an output rotation shaft 20 driven by the motor unit 10, and a pushing mechanism 60 which moves the pinion gear unit 30 towards an engagement location of pinion gears 34 and 35, and an engine starting gear 100, in which an engine is started by a rotation force of the motor unit 10 through the pinion gears 34 and 35, and the engine starting gear 100 which are engaged with each other, the pinion gear unit 30 includes a rotation member 32 which rotates according to rotation of the output rotation shaft

20, a first pinion gear 34 which is fit to the rotation member 32 through a first serration unit 34*ab*, rotates with the rotation member 32 according to the rotation of the output rotation shaft 20, and moves with the rotation member 32 if the pinion gear unit 30 moves towards the engagement location by the pushing mechanism 60, to be initially engaged with the engine starting gear 100, and a second pinion gear 35 which is fit to the rotation member 32 to be adjacent to the first pinion gear 34 through a second serration unit 35*ab*, rotates with the rotation member 32 according to the rotation of the output rotation shaft 20, and moves with the rotation member 32 if the pinion gear unit 30 further moves towards the engagement location by the pushing mechanism. 60, to be engaged with the engine starting gear 100 later than the first pinion gear 34, in a state where the first pinion gear 34 is engaged with the engine starting gear 100, and the fitting is performed by the first and second serration units 34*ab* and 35*ab* so that phases of teeth 34*a* of the first pinion gear 34 and teeth 35*a* of the second pinion gear 35 in a circumferential direction correspond with each other.

Feature 2: In the engine starting device according to Feature 1, the teeth 34*a* of the first pinion gear 34 are in a protruded tooth shape in which an edge thereof is protruded, and the teeth 35*a* of the second pinion gear 35 are in a non-protruded tooth shape.

Feature 3: In the engine starting device according to Feature 1 or 2, a thickness of the first pinion gear 34 in a direction of the engine starting gear 100 is thinner than a thickness of the second pinion gear 35 in a direction of the engine starting gear 100.

Feature 4: In the engine starting device according to any one of Features 1 to 3, the first pinion gear 34 has a function of performing rotation synchronization with the engine starting gear 100, and the second pinion gear 35 has a function of transferring a rotation force of the second pinion gear 35 to the engine starting gear 100 by the engagement with the engine starting gear 100.

Feature 5: In the engine starting device according to any one of Features 1 to 4, a positioning mechanism unit 60 is provided over the first serration unit 34*ab* and the second serration unit 35*ab*, and the fitting is performed by the positioning structure unit provided over the first and second serration units 35*ab* so that the phases of the teeth 34*a* of the first pinion gear 34 and the teeth 35*a* of the second pinion gear 35 in a circumferential direction correspond with each other.

Feature 6: In the engine starting device according to any one of Features 1 to 5, the number of teeth of the first serration unit 34*ab* is integral multiple of the number of teeth of the first pinion gear 34, and the number of teeth of the second serration unit 35*ab* is integral multiple of the number of teeth of the second pinion gear 35.

Feature 7: In the engine starting device according to Feature 6, the number of teeth of the first serration unit 34*ab* and the number of teeth of the second serration unit 35*ab* are same.

Feature 8: In the engine starting device according to any one of Features 5 to 7, the positioning structure unit is a groove provided over the first and second serration units 34*ab* and 35*ab*, and the fitting is performed by overlapping the groove on the first serration unit 34*ab* side and the groove on the second serration unit 35*ab* side so that the phases of the teeth 34*a* of the first pinion gear 34 and the teeth 35*a* of the second pinion gear 35 in a circumferential direction correspond with each other.

Feature 9: In the engine starting device according to any one of Features 5 to 7, the positioning structure unit is formed by cutting-out at least one tooth of the first and second serration units 34*ab* and 35*ab*, over the first and second pinion gears 34 and 35, and the fitting is performed by overlapping the cut-out tooth on the first serration unit 34*ab* side and the cut-out tooth on the second serration unit 35*ab* side so that the phases of the teeth 34*a* of the first pinion gear 34 and the teeth 35*a* of the second pinion gear 35 in a circumferential direction correspond with each other.

Feature 10: In the engine starting device according to any one of Features 5 to 7, the positioning structure unit is formed by configuring at least one tooth of the first and second serration units 34*ab* and 35*ab* so as to have a greater width than the other teeth, over the first and second pinions, and the fitting is performed by overlapping the wide tooth on the first serration unit 34*ab* side and the wide tooth on the second serration unit 35*ab* side so that the phases of the teeth 34*a* of the first pinion gear 34 and the teeth 35*a* of the second pinion gear 35 in a circumferential direction correspond with each other.

Feature 11: In the engine starting device according to any one of Features 5 to 7, the positioning structure unit is formed by providing a protruded portion 34*d* on one of opposed surfaces of the first pinion gear 34 and the second pinion gear 35 and a recessed portion 35*d* on the other one thereof, and the fitting is performed by fitting the protruded portion 34*d* and the recessed portion 35*d* so that the phases of the teeth 34*a* of the first pinion gear 34 and the teeth 35*a* of the second pinion gear 35 in a circumferential direction correspond with each other.

Feature 12: In the engine starting device according to any one of Features 1 to 11, a stopper unit 36 which restricts movement of the first pinion gear 34 and the second pinion gear 35 towards a direction of the engine starting gear 100 is provided on an end portion of the rotation member 32 on the engine starting gear 100 side, an elastic member 33 is disposed on a side opposite to the stopper unit 36 of the rotation member 32 with the first and the second pinion gears 35 interposed therebetween, and the first and second pinion gears 34 and 35 are biased towards the stopper unit 36 side by being pushed by the elastic member 33.

Feature 13: In an engine starting device including a motor unit 10, a pinion gear unit 30 which rotates according to rotation of an output rotation shaft 20 driven by the motor unit 10, and a pushing mechanism 60 which moves the pinion gear unit 30 towards an engagement location of pinion gears 34 and 35, and an engine starting gear 100, in which an engine is started by a rotation force of the motor unit 10 through the pinion gears 34 and 35, and the engine starting gear 100 which are engaged with each other, the pinion gear unit 30 includes a rotation member 32 which rotates according to rotation of the output rotation shaft 20, a first pinion gear 34 which rotates with the rotation member 32 according to the rotation of the output rotation shaft 20, and moves with the rotation member 32 if the pinion gear unit 30 moves towards the engagement location by the pushing mechanism 60, to be initially engaged with the engine starting gear 100, and a second pinion gear 35 which is fit to the rotation member 32 to be adjacent to the first pinion gear 34 through a serration unit, rotates with the rotation member 32 according to the rotation of the output rotation shaft 20, and moves with the rotation member 32 if the pinion gear unit 30 further moves towards the engagement location by the pushing mechanism 60, to be engaged with the engine starting gear 100 later than the first pinion gear 34, in a state where the first pinion gear 34 is engaged with the engine starting gear 100, and the first pinion gear 34 is fit to the second pinion gear 35 through an inter-pinion gear serration unit which is formed between both pinion gears 34 and 35, and the fitting is performed by the inter-pinion gear serration unit so that the phases of the teeth 34*a* of the first pinion gear 34 and the teeth 35*a* of the second pinion gear 35 in a circumferential direction correspond with each other.

Feature 14: In the engine starting device according to any one of Features 1 to 13, the fitting state of the first pinion gear 34 is in a freely fitting state so that the first pinion gear 34 can be inclined with respect to the second pinion gear 35.

Feature 15: In an engine starting device including a starter motor 10, a moving body 31 which slides in an axial direction which is spline-coupled to an output shaft 20 side of the starter motor 10, a pinion gear unit 30 which is attached not to be relatively rotated to an cylindrical rotation member 32 configuring a part of the moving body 31, a pushing mechanism 60 which moves the pinion gear unit 30 to the engagement location of a ring gear, and a ring gear which is engaged with a pinion of the pinion gear unit 30 pushed by the pushing mechanism 60 and starts an engine by transferring a rotation force of the starter motor, the pinion gear unit 30 is in a protruded tooth shape for synchronization and is configured with a first pinion gear 34 which initially collides with the ring gear at the time of starting engagement with the ring gear and a second pinion gear 35 which performs a role of transferring the rotation force after the engagement, and both of the first pinion and the second pinion are serration-fit to each other by a serration unit provided on each inner diameter and a serration unit provided on an outer periphery of the cylindrical rotation member 32.

Feature 16: In the engine starting device according to Feature 15, the number of teeth of the serration units 34*ab* and 35*ab* is integral multiple of the number of teeth of the pinions 34 and 35.

Feature 17: In the engine starting device according to Feature 15, groove units 34*c* and 35*c* are provided as positioning portions on the inner diameters of the first and second pinions 34 and 35.

Feature 18: In the engine starting device according to Feature 15, at least one tooth of the serration units 34*b* and 35*b* provided on the inner diameter on the first and second pinions 34 and 35 is cut out to be set as the positioning portion.

Feature 19: In the engine starting device according to Feature 15, at least one tooth of the serration of the cylindrical rotation member 32 is configured to have a wider width than the others, the width of at least one portion of the serration 34*b* and 35*b* of the inner diameters of the first and second pinions 34 and 35 is differentiated corresponding to the serration 32*a* of the cylindrical rotation member 32, to be set as the positioning portion.

Feature 20: In the engine starting device according to any one of Feature 16 to 19, the position of the first pinion 34 and the second pinion 35 are previously corresponded to each other by the positioning portions provided on the inner diameters of the first and second pinions 34 and 35, to assemble the pinions to the cylindrical rotation member 32.

Feature 21: In an engine starting device including a starter motor 10, a moving body 31 which slides in an axial direction which is spline-coupled to an output shaft 20 side of the starter motor 10, a pinion gear unit 30 which is attached not to be relatively rotated to an cylindrical rotation member 32 configuring a part of the moving body 31, a pushing mechanism 60 which moves the pinion gear unit 30 to the engagement location of a ring gear, and a ring gear 100 which is engaged with pinions 34 and 35 of the pinion gear unit 30 pushed by the pushing mechanism 60 and starts an engine by transferring a rotation force of the starter motor 10, the pinion gear unit 30 is in a protruded tooth shape for synchronization and is configured with a first pinion gear 34 which initially collides with the ring gear 100 at the time of starting engagement with the ring gear 100 and a second pinion gear 35 which performs a role of transferring the rotation force after the engagement, and the first pinion gear 34 is serration-fit to a serration unit 32*a* formed on the cylindrical rotation member 32, and the first pinion gear 34 is fit to a positioning portion 35*d* provided on the second pinion 35.

Feature 22: In the engine starting device according to Feature 21, the second pinion gear 35 is serration-fit to the serration unit 32*a* formed on the cylindrical rotation member 32, and a protruded portion 34*d* (or a recessed portion) of the first pinion gear provided on an abutting surface of the second pinion gear 35 is fit to the recessed portion 35*d* (or a protruded portion) of the second pinion gear 35 provided on an abutting surface of the first pinion gear 34 to perform positioning.

Feature 23: In the engine starting device according to any one of Features 15 to 22, a stopper unit 36 which restricts movement of the pinion gear unit 30 in the axial direction is provided on the cylindrical rotation member 32 configuring a part of the moving body 31, an elastic member 33 such as a spring is provided on a side opposite to the stopper 36 with the pinion gear unit 30 interposed therebetween, and the first pinion gear 34 and the second pinion gear 35 are biased by being pushed to the stopper 36 side by the elastic member 33.

Feature 24: In an engine starting device including a starter motor 10, a pinion gear unit 30 which slides in an axial direction which is spline-coupled to an output shaft 20 side of the starter motor 10, a shift lever 60 which pushes an overrunning clutch and pinions 30, 34, and 35 to a direction of a ring gear 100 of an engine, according to movement of a plunger 50 attracted by turning on a key switch, and a ring gear 100 which is engaged with a pinions 34 and 35 pushed by the shift lever 60 and starts an engine by transferring a rotation force of the starter motor 10, the pinion 30 is in a tooth shape for synchronization, and includes the pinion gear which is divided into a first pinion gear 34 which initially collides with the ring gear at the time of starting engagement with the ring gear and a second pinion gear 35 which performs a role of transferring the rotation force after the engagement, in the axial direction.

Further, when both of the first pinion gear 34 and the second pinion gear 35 are serration-fit to each other by serration units 34*b* and 35*b* provided on each inner diameter and a serration unit 32*a* provided on an outer periphery of the cylindrical rotation member 32 of the moving body 31 which slides in the axial direction which is spline-coupled to the output shaft side of the starter motor, the pinion gear unit 30 in which the number of the teeth of the serration 32*a* provided on the outer periphery of the cylindrical rotation member 32 or the serration 34*ab* and 35*ab* provided on the inner diameter of the first pinion gear 34 and the second pinion gear 35 is integral multiple of the number of teeth of the pinion of the first pinion gear 34 and the number of the teeth of the protruded portion of the second pinion gear 35, is provided.

In addition, a function of easily performing positioning of the teeth of the pinion of the first pinion gear 34 and the protruded portion of the second pinion gear 35 is provided.

[FIG. 2(*a*)]
c LINE
c VIEW
d LINE
d VIEW
[FIG. 2(*c*)]
c VIEW ENLARGED VIEW
[FIG. 2(*d*)]
d VIEW ENLARGED VIEW
[FIG. 3(*a*)]
c LINE
c VIEW
d LINE
d VIEW
[FIG. 3(*c*)]
c VIEW ENLARGED VIEW
[FIG. 3(*d*)]
d VIEW ENLARGED VIEW
[FIG. 4 (*a*)]
cd LINE
d VIEW
c VIEW

The invention claimed is:

1. An engine starting device comprising:

a motor unit;

a pinion gear unit which rotates according to the rotation of an output rotation shaft driven by the motor unit; and a pushing mechanism which moves the pinion gear unit towards an engagement location of a pinion gear and an engine starting gear, wherein an engine is started by a rotation force of the motor unit through the pinion gear and the engine starting gear which are engaged with each other, the pinion gear unit includes a rotation member which rotates according to the rotation of the output rotation shaft, a first pinion gear which is fit to the rotation member through a first serration unit, rotates with the rotation member according to the rotation of the output rotation shaft, and moves with the rotation member when the pinion gear unit moves towards the engagement location by the pushing mechanism, to be initially engaged with the engine starting gear, and a second pinion gear which is fit to the rotation member to be adjacent to the first pinion gear through a second serration unit, rotates with the rotation member according to the rotation of the output rotation shaft, and moves with the rotation member when the pinion gear unit further moves towards the engagement location by the pushing mechanism, to be engaged with the engine starting gear later than the first pinion gear, in a state where the first pinion gear is engaged with the engine starting gear, and the first pinion gear and the second pinion gear are configured to be moved toward each other in the circumferential direction at the time of assembly, thereby the fitting is performed by the first and second serration units so that phases of teeth of the first pinion gear and teeth of the second pinion gear in a circumferential direction correspond with each other.

2. The engine starting device according to claim 1, wherein the tooth of the first pinion gear is in a protruded tooth shape in which an edge thereof is protruded, and the tooth of the second pinion gear is in a non-protruded tooth shape.

3. The engine starting device according to claim 1, wherein a thickness of the first pinion gear in a direction of the engine starting gear is thinner than a thickness of the second pinion gear in a direction of the engine starting gear.

4. The engine starting device according to claim 1, wherein the first pinion gear has a function of performing rotation synchronization with the engine starting gear, and the second pinion gear has a function of transferring a rotation force of the second pinion gear to the engine starting gear by the engagement with the engine starting gear.

5. The engine starting device according to claim 1, wherein a positioning mechanism unit is provided over the first serration unit and the second serration unit, and the fitting is performed by the positioning mechanism unit provided over the first and second serration units so that the phases of the teeth of the first pinion gear and the teeth of the second pinion gear in a circumferential direction correspond with each other.

6. The engine starting device according to claim 1, wherein the number of teeth of the first serration unit is integral multiple of the number of teeth of the first pinion gear, and the number of teeth of the second serration unit is integral multiple of the number of teeth of the second pinion gear.

7. The engine starting device according to claim 6, wherein the number of teeth of the first serration unit and the number of teeth of the second serration unit are same.

8. The engine starting device according to claim 5, wherein the positioning mechanism unit is a groove provided over the first and second serration units, and the fitting is performed by overlapping the groove on the first serration unit and the groove on the second serration unit so that the phases of the teeth of the first pinion gear and the teeth of the second pinion gear in a circumferential direction correspond with each other.

9. The engine starting device according to claim 5, wherein the positioning mechanism unit is formed by cutting-out at least one tooth of the first and second serration units over the first and second pinions, and the fitting is performed by overlapping the cut-out tooth on the first serration unit and the cut-out tooth on the second serration unit so that the phases of the teeth of the first pinion gear and the teeth of the second pinion gear in a circumferential direction correspond with each other.

10. The engine starting device according to claim 5, wherein the positioning mechanism unit is formed by configuring at least one tooth of the first and second serration units so as to have a greater width than the other teeth over the first and second pinions, and the fitting is performed by overlapping the wide tooth on the first serration unit and the wide tooth on the second serration unit so that the phases of the teeth of the first pinion gear and the teeth of the second pinion gear in a circumferential direction correspond with each other.

11. The engine starting device according to claim 5, wherein the positioning mechanism unit is formed by providing a protruded portion on one of opposed surfaces of the first pinion gear and the second pinion gear and a recessed portion on the other one thereof, and the fitting is performed by fitting the protruded portion and the recessed portion so that the phases of the teeth of the first pinion gear and the teeth of the second pinion gear in a circumferential direction correspond with each other.

12. The engine starting device according to claim 1, wherein a stopper unit which restricts movement of the first pinion gear and the second pinion gear towards a direction of the engine starting gear is provided on an end portion of the rotation member on the engine starting gear side, an elastic member is disposed on a side opposite to the stopper unit of the rotation member with the first and the second pinion gears interposed therebetween, and the first and second pinion gears are biased towards the stopper unit side by being pushed by the elastic member.

13. An engine starting device comprising:

a motor unit;

a pinion gear unit which rotates according to the rotation of an output rotation shaft driven by the motor unit; and a pushing mechanism which moves the pinion gear unit towards an engagement location of a pinion gear and an engine starting gear, wherein an engine is started by a rotation force of the motor unit through the pinion gear and the engine starting gear which are engaged with each other, the pinion gear unit includes a rotation member which rotates according to the rotation of the output rotation shaft, a first pinion gear which rotates with the rotation member according to the rotation of the output rotation shaft, and moves with the rotation member when the pinion gear unit moves towards the engagement location by the pushing mechanism, to be initially engaged with the engine starting gear, and a second pinion gear which is fit to the rotation member to be adjacent to the first pinion gear through a serration unit, rotates with the rotation member according to the rotation of the output rotation shaft, and moves with the rotation member when the pinion gear unit further moves towards the engagement location by the pushing mechanism, to be engaged with the engine starting gear later than the first pinion gear, in a state where the first pinion gear is engaged with the engine starting gear, and an inner periphery surface portion of the first pinion gear on a side opposite to the engine starting gear is fit to an outer periphery surface portion of the second pinion gear on the engine starting gear side through an inter-pinion gear serration unit which is formed between both pinion gears, and the fitting is performed by the inter-pinion gear serration unit so that the phases of the teeth of the first pinion gear and the teeth of the second pinion gear in a circumferential direction correspond with each other.

14. The engine starting device according to claim 1, wherein the fitting state of the first pinion gear is in a freely fitting state so that the first pinion gear can be inclined with respect to the second pinion gear.

15. The engine starting device according to claim 13, wherein the fitting state of the first pinion gear is in a freely fitting state so that the first pinion gear can be inclined with respect to the second pinion gear.

* * * * *